US006006489A

United States Patent [19]

Zadok

[11] Patent Number: 6,006,489

[45] Date of Patent: Dec. 28, 1999

[54] AESTHETIC SCREEN, PANEL, OR GLASS ENCLOSURE CONSTRUCTION

[76] Inventor: Yigal Zadok, 3121 Rosewood Ct., Davie, Fla. 33328

[21] Appl. No.: 09/061,989

[22] Filed: Apr. 17, 1998

[51] Int. Cl.[6] ..... E04B 1/61

[52] U.S. Cl. ..... 52/773; 52/213; 52/204.53; 52/765; 52/769; 52/775; 52/781; 52/235

[58] Field of Search ..... 52/765, 769, 775, 52/781, 773, 762, 764, 235, 213, 273, 277

[56] References Cited

U.S. PATENT DOCUMENTS

| | | | |
|---|---|---|---|
| 3,196,992 | 7/1965 | Owen | 189/36 |
| 3,233,381 | 2/1966 | Von Wedel | 52/498 |
| 3,342,001 | 9/1967 | Arnd | 52/498 |
| 3,475,870 | 11/1969 | Birum, Jr. | 52/211 |
| 3,712,005 | 1/1973 | Eschbach et al. | 52/210 |
| 4,376,359 | 3/1983 | Redman | 52/127 |

*Primary Examiner*—Christopher T. Kent
*Assistant Examiner*—Nkeisha J. Maddox
*Attorney, Agent, or Firm*—Smith & Hopen, P.A.; Ronald E. Smith

[57] ABSTRACT

An enclosure for a room, patio, or the like is made of modular parts that hide from view all fasteners and other functional parts. The parts include upstanding regular posts, corner posts, open back posts, horizontal beams and chair rails, as well as door frames, door jambs, door sweeps, and other parts required for an enclosure construction. Aesthetic cover members are snap-fittingly engaged to the modular parts and confronting pairs of the cover members, in a first embodiment, are very closely spaced to one another to accommodate a screen between them. In second and third embodiments, the confronting cover members have larger spaces between them to accommodate opaque, translucent, or transparent panels of about one-half inch and three-quarter inches, respectively.

28 Claims, 9 Drawing Sheets

AESTHETIC SCREEN, PANEL, OR GLASS ENCLOSURE CONSTRUCTION

BACKGROUND OF THE INVENTION

1. Field of the Invention

This invention relates, generally, to apparatus and methods for making enclosed structures of various types that include screens and/or panels of opaque, translucent, or transparent construction. More particularly, it relates to a construction technique that hides all of the unattractive parts of a screen, panel, or glass enclosure.

2. Description of the Prior Art

Screen, panel, and/or glass enclosures such as rooms, patios, porches, and the like are built by erecting frames that may include headers for attachment to an existing structure, posts, beams, door jambs, door sweeps, chair rails, and the like. Screens, opaque or translucent panels, and/or glass panels complete the structure. In a screen enclosure, various parts of the frame include channels formed therein that receive elongate rubber liners that are inserted, with a well-known hand tool that includes a roller, into the channels in overlying relation to the screen edges to secure the screens into position. Conventional construction techniques result in the liners being exposed to view, along with flanges, nuts, bolts, and other utilitarian but unsightly parts. In panel enclosures, whether of opaque, translucent, or glass panels, conventional construction techniques also leave bolts and the like in view.

What is needed, then, is a construction technique that hides from view not only the rubber liners that hold screens into place, but also the bolts and other such parts as well in screen and panel/glass enclosures.

However, in view of the art considered as a whole at the time the present invention was made, it was not obvious to those of ordinary skill in this art how such a construction method could be provided.

SUMMARY OF THE INVENTION

The long-standing but heretofore unfulfilled need for an apparatus that overcomes the limitations of the prior art is now met by a new, useful, and nonobvious invention. The present invention includes a method for building a screen or a panel/glass enclosure.

An elongate frame member having a predetermined extent and having a predetermined number of sides is provided. A first pair of cover-engaging members are formed along the extent of the frame member on a preselected first side thereof. A second pair of cover-engaging members is formed along the extent of the frame member on the first side thereof in transversely spaced apart relation to the first pair of cover-engaging members. An elongate first cover is attached to the first pair of cover-engaging members, and in a screen enclosure embodiment, a preselected screen edge is attached to the first cover by inserting a screen retaining means into a screen retaining means-receiving groove formed in the first cover. The screen retaining means overlies the preselected screen edge.

An elongate second cover is attached to the second pair of cover-engaging members. In the screen enclosure embodiment, the first and second covers are sized and configured so that they confront and substantially abut one another along their respective extents when attached to their respective cover-engaging members and so that they collectively cover the preselected side of the frame member. In the screen enclosure embodiment, the screen retaining means-receiving groove is positioned in the first cover so that it cannot be seen when the first and second elongate covers are respectively attached to the first and second cover-engaging members in confronting relation to one another.

In this way, a screen edge secured to the first cover is sandwiched between the first and second covers, the screen retaining means that secures the screen edge to the first cover is hidden from view, the first and second pairs of cover-engaging members are hidden from view, and the first side of the frame member is hidden from view.

There is no screen or screen-retaining groove formed in the cover members in the panel/glass enclosure embodiment.

In all embodiments, a pair of depending legs are integrally formed with each cover member, and the legs snap-fittingly engage the cover-engaging members formed on the various frame members.

In the screen enclosure embodiment, the depending leg nearest the screen is transversely offset in a direction away from the screen so that when two cover members are snapped into their respective cover-engaging members, the cover members abut one another and sandwich a screen therebetween.

In a first panel/glass enclosure embodiment, the depending leg nearest the opaque, translucent, or transparent panel is in co-planar alignment with the edge of the cover nearest the panel. Thus, there is a panel-accommodating space between confronting cover members.

It should be appreciated that as used hereinafter, the term "panel" or "panel/glass" includes opaque, translucent, and transparent panels such as glass or acrylic panels. It should also be understood that a single enclosure when fully constructed may include any number and mixture of screens, opaque panels, translucent panels, and transparent panels.

In a second panel/glass enclosure embodiment, the depending leg nearest the panel is transversely offset toward the panel, thereby creating a panel-accommodating space that is greater than the panel-accommodating space of the first embodiment.

In both panel enclosure embodiments, a panel is supported along its edge by a flat wall formed in the frame member that divides the first and second pair of cover-engaging members from one another.

It is a primary object of this invention to advance the art of screen and panel/glass enclosure construction by providing parts and methods that hide bolts, nuts, rubber liners, and the like from view so that the screen or panel/glass enclosure has a very high level of aesthetic appeal.

Another object is to provide screen and panel enclosure construction methods having minimal reliance on tools and having, instead, many parts that are snapped together in the absence of tools.

Yet another object is to provide novel frames for panel enclosures made from panels of varying thicknesses.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
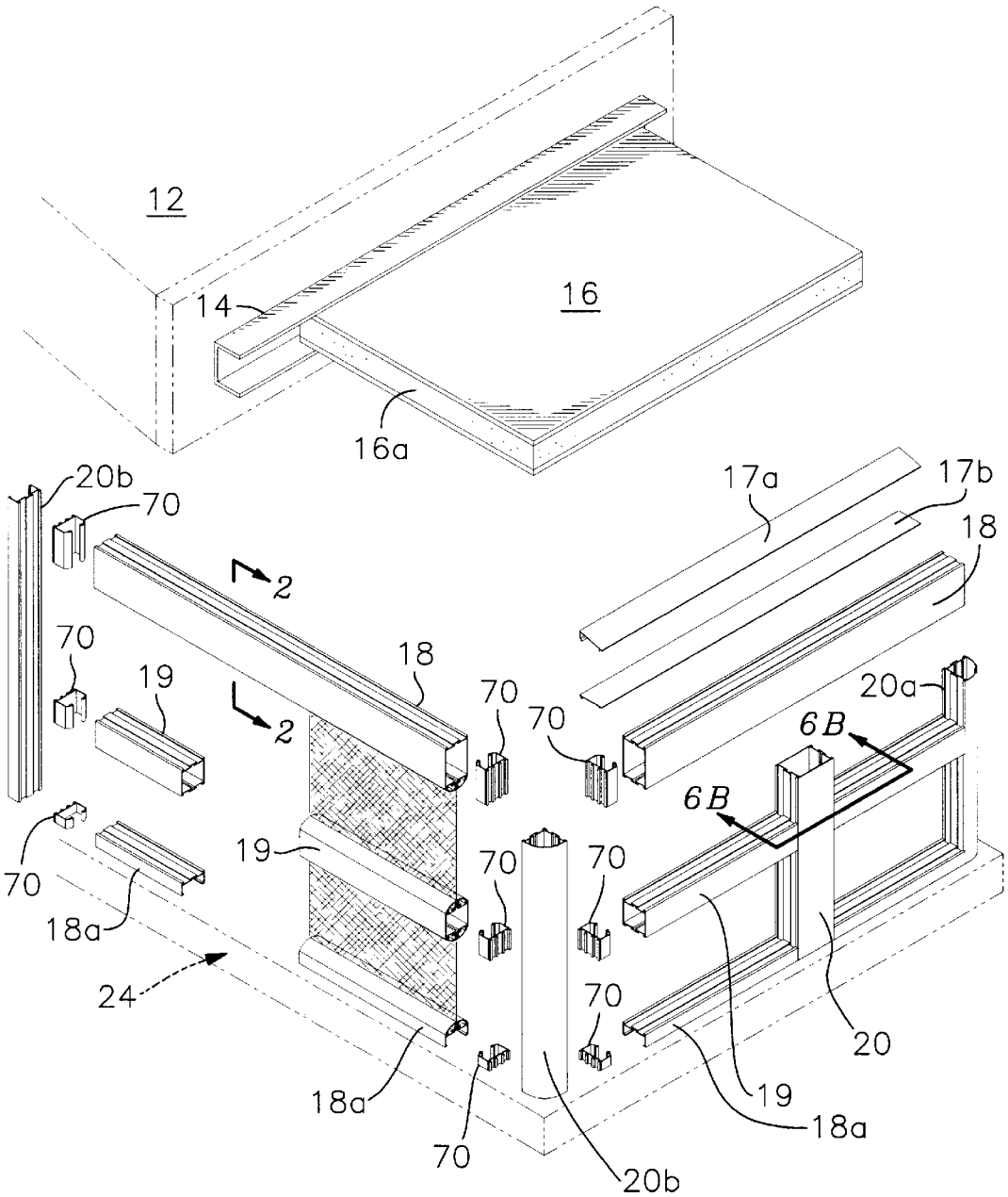
FIG. 1 is an exploded, perspective view of a screen enclosure made in accordance with the teachings and suggestions of this invention.

Referring now to FIG. 1, it will there be seen that an exemplary embodiment of the invention is denoted as a whole by the reference numeral 10.

Figure 1A:
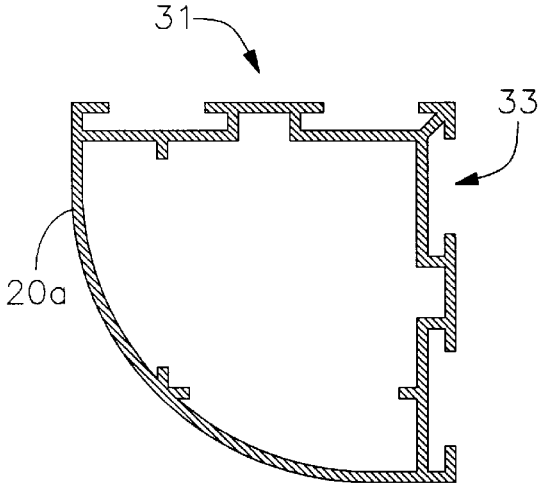
FIG. 1A is a sectional view of a corner post.

Enclosure 10 is attached to an existing structure 12. A wall header 14, which may be in the form of a channel member as depicted, is secured by suitable means to existing structure 12. A plurality of roof panels 16 have their respective inboard ends snugly received within channel-shaped wall header 14. Their respective outboard ends are supported by at least one transversely disposed beam 18 that is in turn supported by at least one vertically disposed regular post 20 and corner posts 20*a* (see FIG. 1A).

Figure 2:
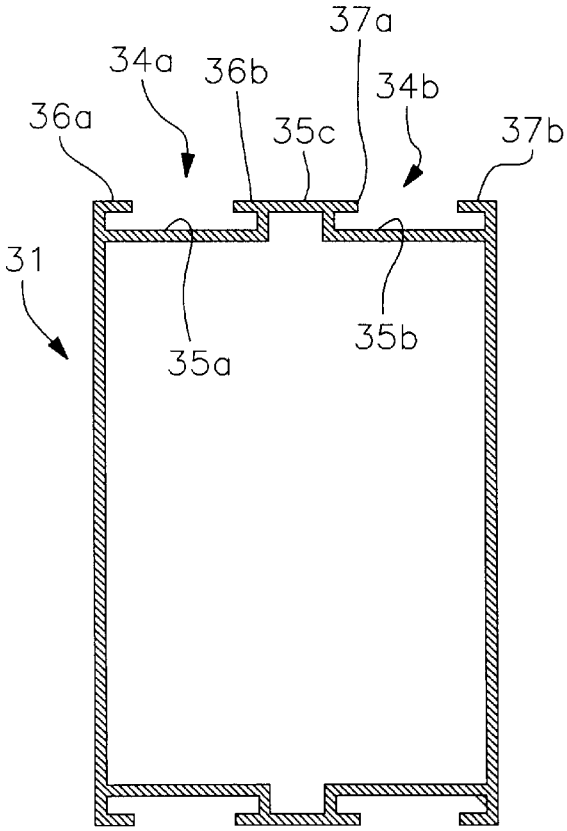
FIG. 2 is a transverse sectional view taken along line 2—2 in FIG. 1.

Beams 18 and posts 20 have the same structural configuration but are given separate reference numerals in view of their different functions. Chair rails 19 also have the same configuration, but may have less vertical extent than a post or a beam. The cross-sectional view provided in FIG. 2 is thus the same for a post or a beam. In the claims that follow, beams 18, chair rails 19, and posts 20 are generically referred to as frame members.

The respective longitudinal sides 16*a* of the panels 16 are interlocked to one another in well known ways and the longitudinally disposed sides of the completed roof are supported by at least one longitudinally disposed beam 18.

Figure 1B:
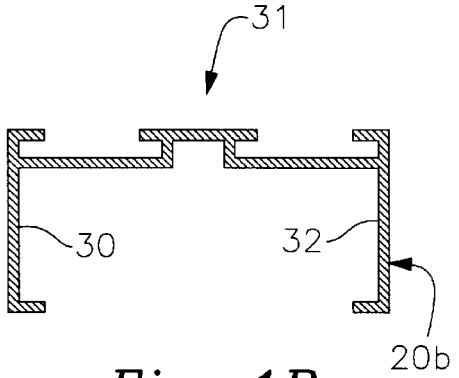
FIG. 1B is a sectional view of an open-back post.

The slope of the roof formed by roof panels 16 varies between applications. Accordingly, a slope adapter such as slope adapter 17*a* or 17*b* is snap-fittingly attached to transverse beam 18 to support roof panels 16 of varying pitches; see also FIGS. 1D and 1E. Slope adapter 17*a* is used for a relatively steep roof and slope adapter 17*b*, which is essentially unsloped, is employed in roofs having nominal slope. For example, a ½/12 pitch adapter 17*c* is depicted in FIG. 1E. Slope adapters 17*a*, 17*b* are provided in any slope desired. Note that each adapter has a pair of depending legs and that each depending leg has a detent formed in its free end. These detents releasably engage beam 18 in the manner depicted in FIG. 1F.

An upstanding half-post member 20*b* (see also FIG. 1B), preferably known as an open-back post, is secured to a vertical wall of existing structure 12 by any suitable means; it performs substantially the same function as regular posts 20 and corner posts 20*a*, but since it is mounted to existing structure 12, it may be longitudinally bisected to save materials, i.e., a single regular beam 18 is bisected to provide two open-back posts 20*b*, thereby saving materials. In a simple screen enclosure, only two half posts are needed because each abuts an existing structural wall as depicted; FIG. 1 depicts only one open-back post to simplify the drawing.

Regular posts 20, corner posts 20*a*, and open-back posts 20*b* are all supported at their respective lowermost ends by a suitable support surface such as a concrete slab 24.

Open-back posts 20*b* are also positioned horizontally in overlying relation to concrete slab 24, along the peripheral edges thereof as depicted. At their respective opposite ends, they abut regular posts 20, corner posts 20*a*, and upstanding cover-posts 20*a*. Since they are horizontally disposed, the open-back posts that overlie support surface 24 are termed open-back beams 18*a*.

Chair rails 19 are also provided in the form of regular posts 20 but are beam-like in view of their horizontal orientation.

Figure 1C:
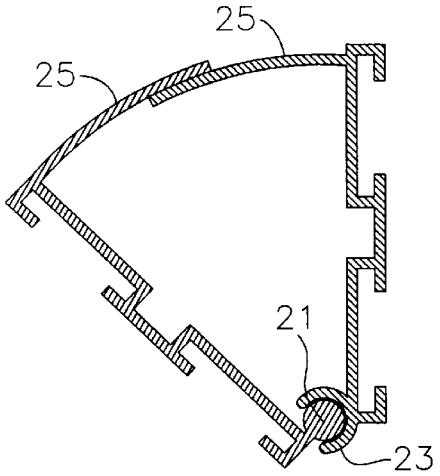
FIG. 1C is a sectional view of a variable degree corner post.
Figure 1D:
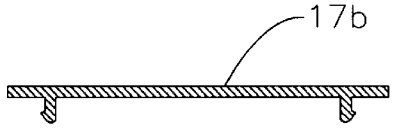
FIG. 1D is an end view of a flat slope adapter.
Figure 1E:
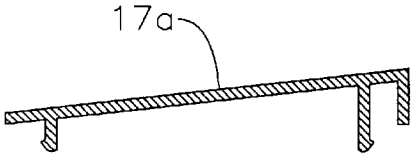
FIG. 1E is an end view of a pitched slope adapter.
Figure 1F:
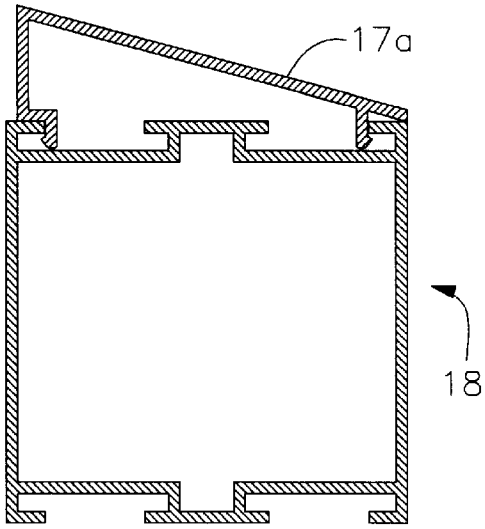
FIG. 1F depicts a pitched slope adapter engaged to a beam.

FIG. 1C depicts a variable degree corner post 20*c* that includes a post 21 pivotally mounted in a channel 23. Arcuate exterior surfaces 25, 25 are slideable with respect to one another as post 21 rotates within channel 23. Accordingly, corner post 20*c* may be employed in constructions where screens or panels forming different walls are set at an angle other than ninety degrees with respect to one another.

Figure 2A:
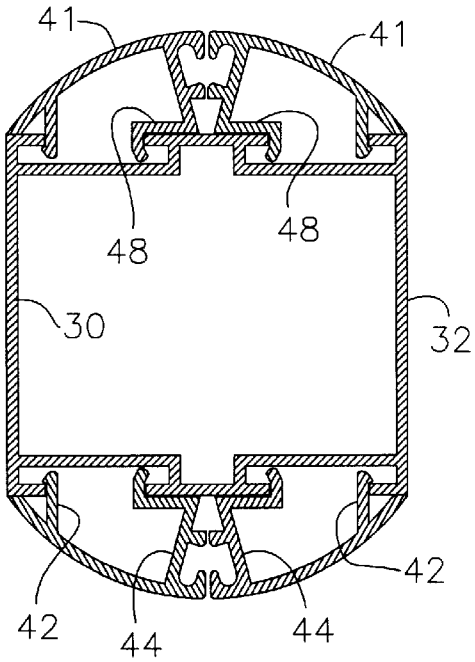
FIG. 2A is a transverse sectional view taken along line 2A—2A in FIG. 1.

FIG. 2 depicts a beam 18 and FIG. 2A depicts a post 20 in transverse cross section. Flat side walls 30, 32 are aesthetically pleasing and therefore need not be covered. Sides 31, 33, however, are functional and not particularly aesthetic; they are completely covered with aesthetic cover members when the novel enclosure is in its fully constructed form.

Each functional side 31, 33 includes a pair of cover-engaging members, generally denoted as 34*a*, 34*b*. More particularly, each cover-engaging member 34*a*, 34*b* includes a bottom wall 35*a*, 35*b* that is slightly inset from the respective ends of flat side walls 30, 32, and a pair of overhang members 36*a*, 36*b* and 37*a*, 37*b* that are parallel to said bottom walls. Each overhang member defines a small undercut or recessed area that is not numbered to avoid cluttering the drawings.

Significantly, each pair of cover-engaging members 34*a*, 34*b* engages a separate cover member. Each functional side of members 18, 20 is covered for aesthetic reasons by a pair of preferably arcuate cover members disposed in confronting relation to one another, thereby collectively forming an elongate hemispherical profile. In the screen enclosure embodiment, the cover members are sized and complementally configured with respect to one another to substantially abut one another and provide the appearance of a whole cover when attached to their respective cover-engaging members 34*a*, 34*b*. In the panel enclosure embodiments, the confronting cover members are transversely spaced apart from one another by an amount sufficient to accommodate a panel therebetween.

Both cover members in a pair of cover members, however, are not provided for aesthetic reasons only. In a first embodiment of the cover members, one of them is specifically configured to engage the peripheral edge of a screen. In a second embodiment, both cover members in a pair of confronting cover members are configured to receive therebetween a panel/glass member having a first predetermined thickness, and in a third embodiment, both cover members in a pair of confronting panel members are configured to receive therebetween a panel/glass member having a preselected thickness greater than the thickness of the panel engaged by the confronting panel members of the second embodiment.

Figure 3:
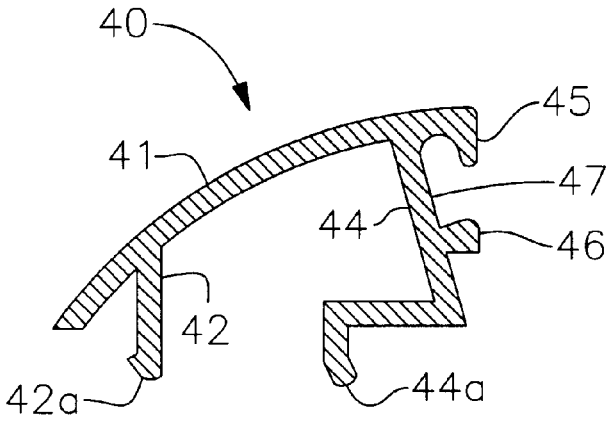
FIG. 3 is an end view of a cover member used in the screen enclosure embodiment.

The first embodiment of cover members is depicted in FIG. 3. Cover member 40 has an arcuate surface 41 that is the only part of the cover member that is exposed to view when construction of the screen or panel enclosure is completed; see FIG. 3A. A first depending leg 42 of generally straight construction has a detent 42*a* formed in its free end; said detent snap-fittingly engages overhang 36*a* by snapping into the undercut recess defined thereby when cover member 40 is attached to cover-engaging member 34*a*.

Figure 3A:
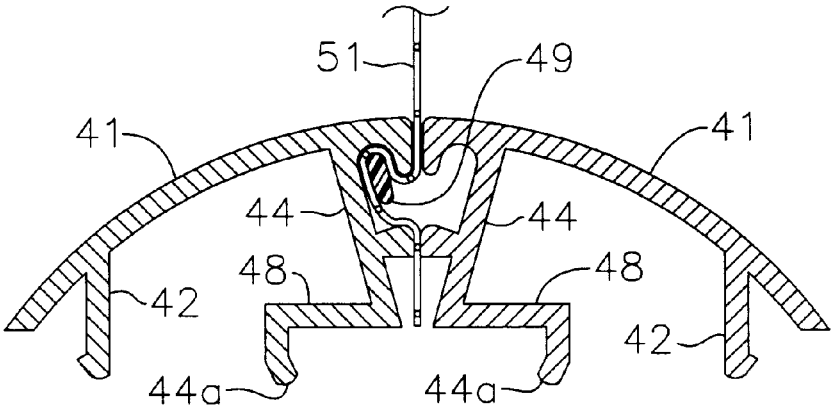
FIG. 3A is an end view depicting two of the FIG. 3 cover members when disposed in confronting relation to one another.

A second depending leg 44 is of irregular form but also terminates as at 44*a* in a free end that snap-fittingly engages overhang 36*b* of cover-engaging member 34*a*, in much the same way as detent 42*a* of leg 42 is engaged, when cover member 40 is installed. Lips 45 and 46 cooperate with leg 44 to collectively define a recessed area 47 that receives rubber liner 49 when a screen is installed. Liner 49 overlies screen 51 and holds it in recessed area 47, it being understood that said liner is installed with a well-known roller tool. Accordingly, when the confronting counterpart of cover member 40 has its respective detents engaged in the undercuts defined by overhangs 37*a*, 37*b*, lip 45 substantially abuts the lip of its confronting counterpart and screen 51 is sandwiched therebetween as depicted in FIGS. 1 and 3A. This conceals from view liner 49, depending legs 42, 44 and cover-engaging members 34*a*, 34*b*. Thus, only flat side walls 30, 32 and arcuate cover member walls 41, 41 are visible.

It should be noted that depending leg 44, i.e., the inboard leg or the leg nearest the screen, has a transversely offset part 48 that extends away from the screen. This positions the respective inboard edges of the confronting cover members into abutting relation to one another when they are attached to a frame member as perhaps best understood in connection with FIG. 3A.

Figure 4:
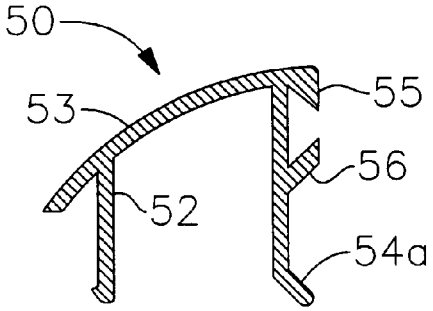
FIG. 4 is an end view of a cover member used in a first panel enclosure embodiment.
Figure 4A:
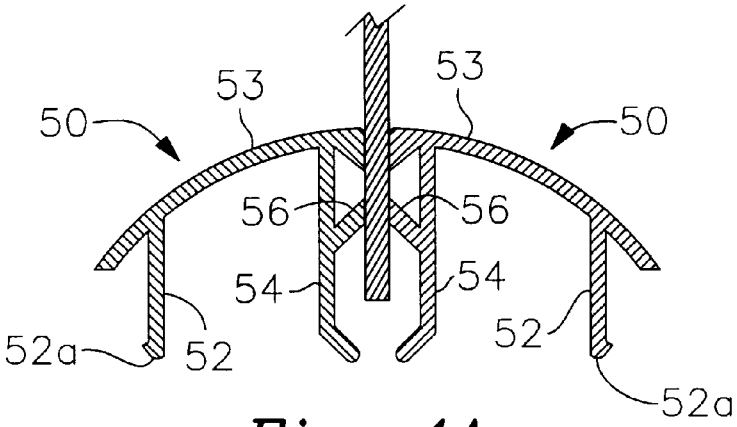
FIG. 4A is an end view depicting two of the FIG. 4 cover members when disposed in confronting relation to one another.

The second embodiment of the novel cover member is depicted in FIG. 4 and is denoted 50 as a whole; the arcuate part thereof that is exposed to view when an enclosure assembly is complete is denoted 53. This embodiment holds an opaque panel, such as a sheet of drywall, also known as sheetrock, or a translucent or transparent panel, between a pair of confronting cover members when they are snap-fittingly engaged to a frame member such as depicted in FIG. 4A. Accordingly, there is no rubber liner-receiving recess as in the first embodiment. Depending legs 52 and 54 end in detents 52*a*, 54*a*, respectively, which snap-fittingly engage overhangs 34*a*, 34*b* as in the first embodiment. A space of about a quarter of an inch wide, sufficient to receive a quarter inch thick panel/glass, is defined between the inboard surfaces of the confronting cover members. The edge of a panel sandwiched between confronting cover members 50 abuts and is supported by support wall 35*c* (see FIG. 2) that forms a part of sides 31, 33 of a beam 18 or post 20. The respective free ends of arms 55 and 56 abut said panel and hold it in a vertical position, in sandwiched relation to the respective counterpart free ends of a confronting cover 50.

Note that said free ends of arms 55, 56 are co-planar with one another and with the detent 54*a* formed in the free end of depending leg 54, said leg being nearest the panel. This co-planar alignment, as distinguished from the transverse offset formed in the depending leg nearest the screen in the first embodiment, positions the confronting cover members in a transversely spaced apart relation to one another sufficient to receive a panel/glass of predetermined thickness therebetween.

Figure 5:
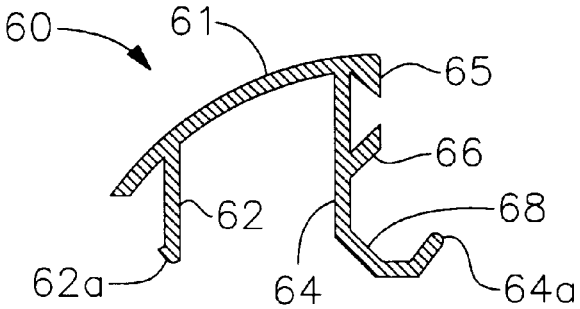
FIG. 5 is an end view of a cover member used in a second panel enclosure embodiment.
Figure 5A:
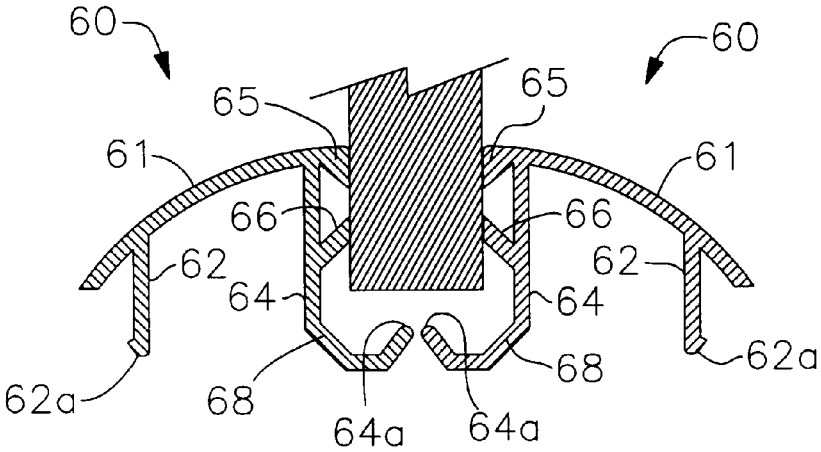
FIG. 5A is an end view depicting two of the FIG. 5 cover members when disposed in confronting relation to one another.

The third embodiment of the novel cover is denoted 60 as a whole in FIG. 5. It includes arcuate visible surface 61 and depending legs 62, 64 which end in detents 62*a*, 64*a*, respectively. The respective free ends of arms 65, 66 abut and help support a panel (or sheet of glass or acrylic or the like) having a thickness of about 13/16", it being understood that said panel is sandwiched between arms 65, 66 and similar arms of a confronting panel 60 (FIG. 5A) and that the innermost edge of said panel abuts support wall 35*c* (FIG. 2).

Transverse offset 68 formed in leg 64, the leg nearest the panel, serves to position the free ends of arms 65, 66 further away from one another than in the second embodiment.

Figure 6A:
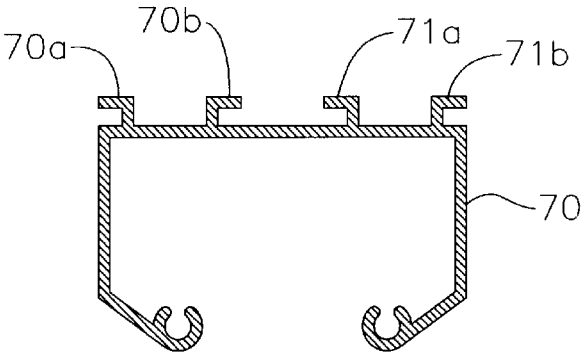
FIG. 6A is an end view of a connecting bracket.
Figure 6B:
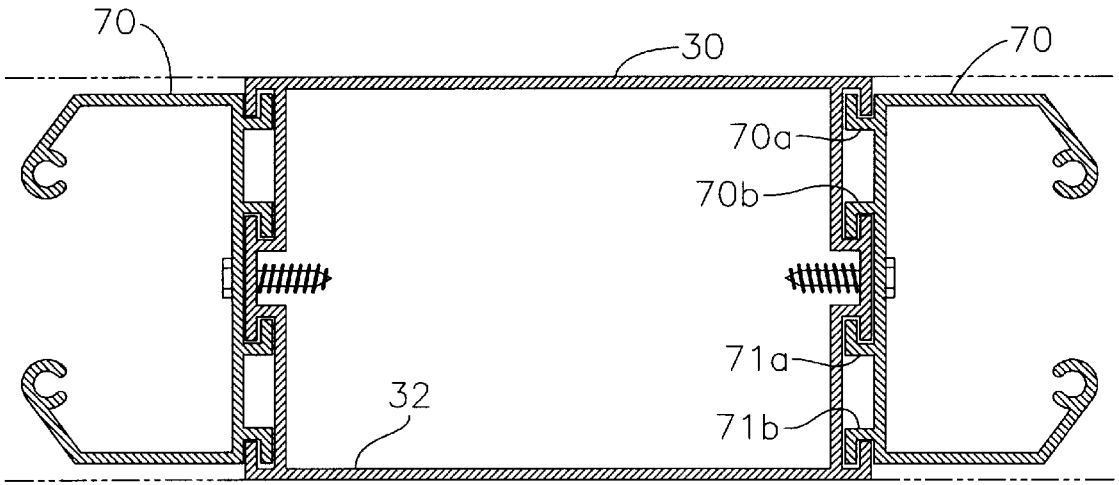
FIG. 6B is a sectional view taken along line 6B—6B in FIG. 1.

FIGS. 6A and 6B depict a connecting bracket 70 that interconnects an upstanding post 20 to a beam 18. Bracket 70 also interconnects beams 18 to corner posts 20*a* and open back posts 20*b*. It includes "L"-shaped legs 70*a*, 70*b*, 71*a*, 71*b* that snap-fittingly fit into the undercut recesses defined by overhang members 36*a*, 36*b* and 37*a*, 37*b*, respectively, as depicted in FIG. 6B.

Figure 7:
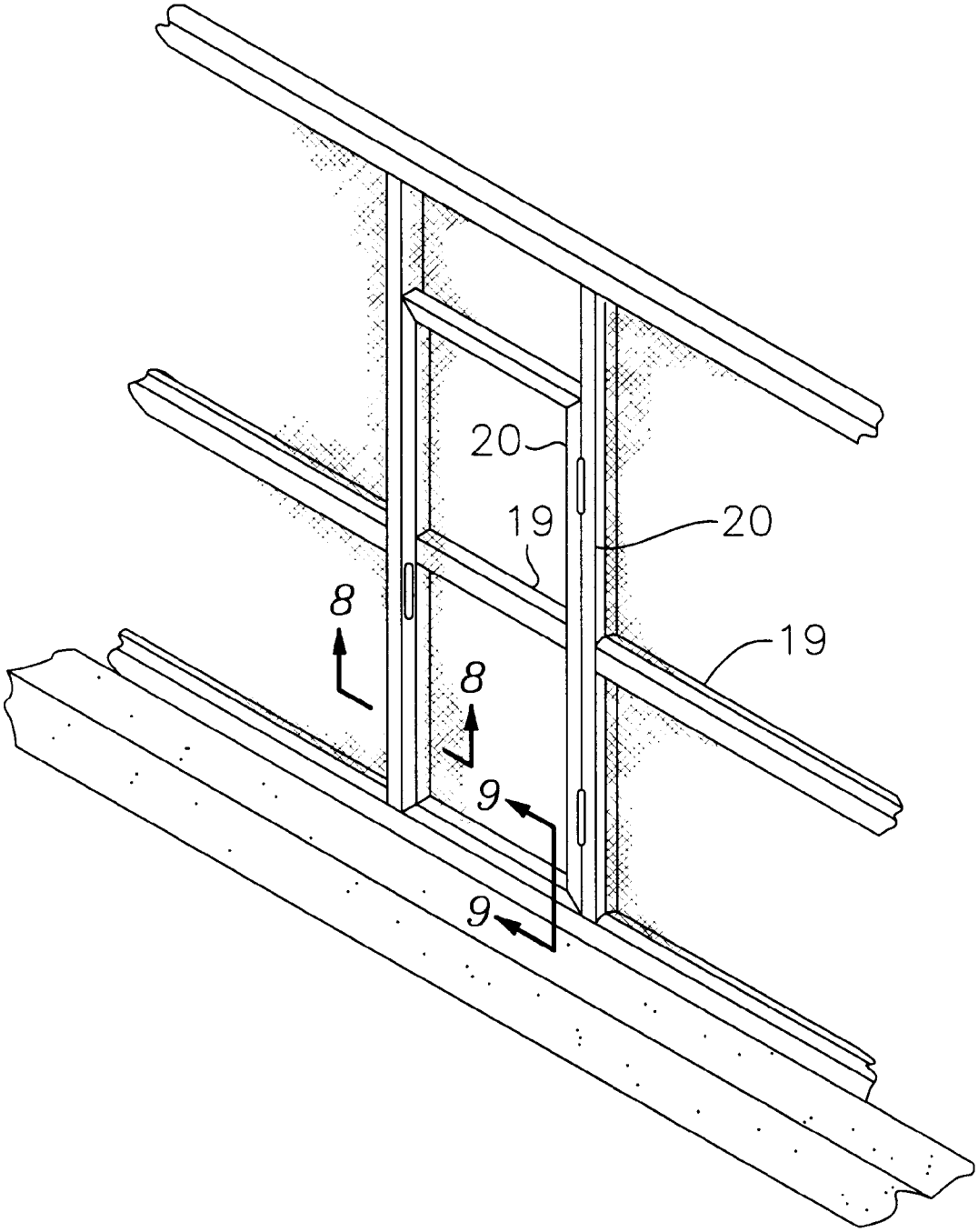
FIG. 7 is a front elevational view of a screen door assembly including the novel parts.
Figure 8:
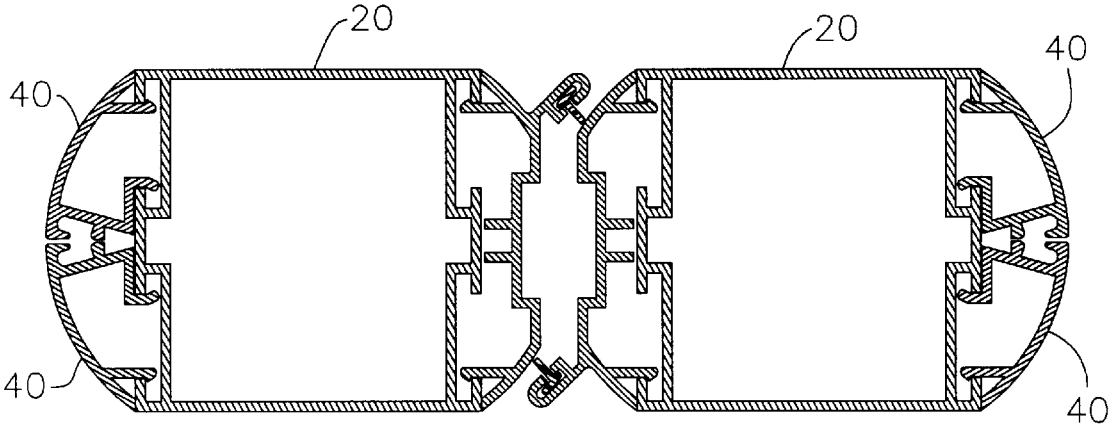
FIG. 8 is a sectional view taken along lines 8—8 in FIG. 7.
Figure 8A:
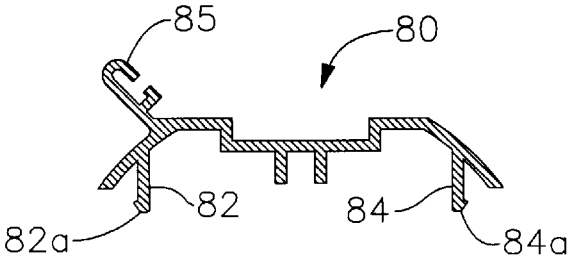
FIG. 8A is an end view of a novel frame cover that serves as a door jamb.

A screen door and its associated parts are depicted in FIG. 7. As best understood in connection with FIGS. 8 and 8A, the door frame and jamb are both made by attaching a cover member 80 (FIG. 8A) to the confronting inboard surfaces of posts 20, 20 (FIG. 8). Note that the respective outboard sides of said posts are covered by cover members 40 (FIGS. 3 and 3A). Note also that cover member 80 has a pair of depending legs 82, 84 and that a detent 82*a*, 84*a* is formed in the free end of each of said legs for snap-fitting engagement with the undercut areas defined by overhangs 36*a*, 37*a* of posts 20. A suitable wiper or weather-strip is retained within part 85 of said cover member 80.

Figure 9:
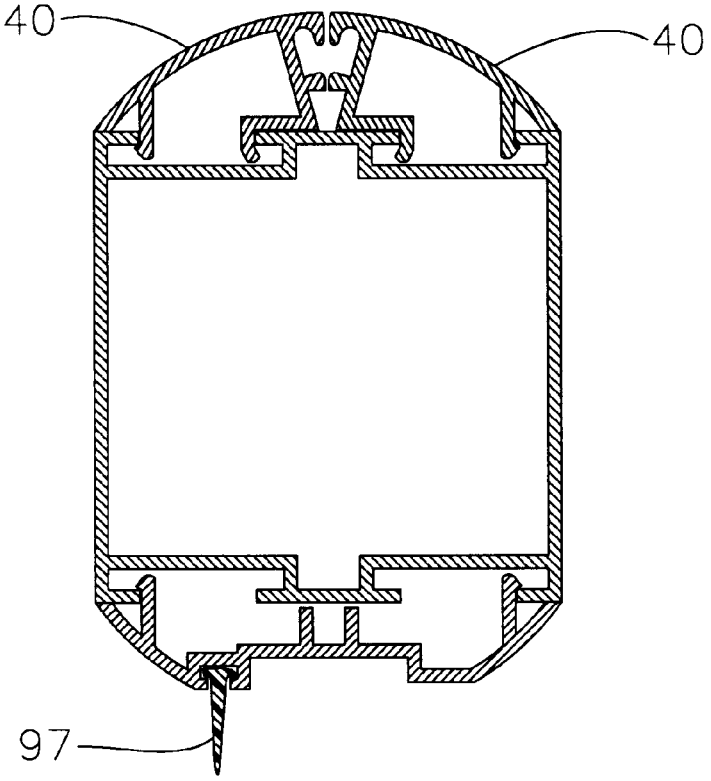
FIG. 9 is a sectional view taken along line 9—9 in FIG. 7.
Figure 9A:
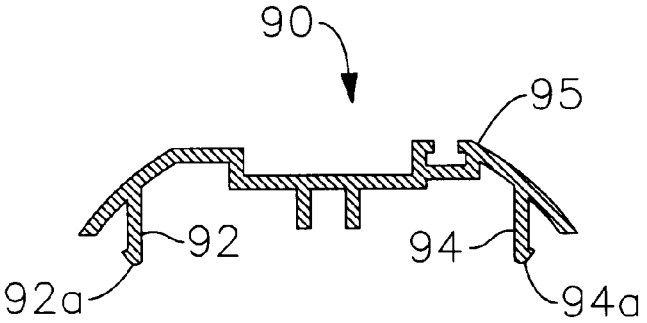
FIG. 9A is an end view of a novel frame cover that serves as a bottom door sweep.

A similar part 90, depicted in FIGS. 9 and 9A, is used to cover the bottom wall of a horizontal beam 18 in a door sweep construction. Post 90 has depending legs 92, 94 that terminate in detents 92*a*, 94*a*, respectively, and which snap-fittingly engage overhangs 36*a*, 37*a*.

This invention is highly versatile and is not limited to the particular application shown and described herein. It revolutionizes the art of screen and panel room construction because it provides the first such construction where all of the bolts, flanges, and other utilitarian features of the construction are aesthetically hidden from view. Moreover, the cover members that cover the various utilitarian features are snap-fit into place, thereby providing an easy-to-assemble structure. Significantly, the cover members cooperate with the frame members they cover to hold a screen or panel into position, i.e., the cover members perform a utilitarian function as well.

It will thus be seen that the objects set forth above, and those made apparent from the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A method for building a screen enclosure, comprising the steps of:

providing an elongate frame member having a predetermined extent and having a predetermined number of sides;

forming a first pair of cover-engaging members along said extent of said frame member on a preselected first side thereof;

forming a second pair of cover-engaging members along said extent of said frame member on said preselected first side thereof in transversely opposed relation to said first pair of cover-engaging members;

attaching an elongate first cover to said first pair of cover-engaging members;

attaching a preselected screen edge to said first cover by inserting a screen retaining means into a screen retaining means-receiving groove formed in said first cover, said screen retaining means overlying said preselected screen edge;

attaching an elongate second cover to said second pair of cover-engaging members;

sizing and configuring said first and second covers so that they confront and substantially abut one another along their respective extents when attached to their respective cover-engaging members and so that they collectively cover said preselected first side of said frame member;

positioning said screen retaining means-retaining groove in said first cover so that it cannot be seen when said first and second elongate covers are respectively attached to said first and second cover-engaging members in confronting relation to one another;

whereby a screen edge secured to said first cover is sandwiched between said first and second covers;

whereby the screen retaining means that secures said screen edge to said first cover is hidden from view;

whereby said first and second pairs of cover-engaging members are hidden from view; whereby said preselected first side of said frame member is hidden from view; and whereby said cover and said cover-engaging members are associated only with said preselected first side of said frame member.

2. The method of claim 1, further comprising the step of providing said first cover and said second cover with respective exposed surfaces that are visible when the screen enclosure is finished and with respective transversely spaced apart pairs of depending legs that respectively snap-fittingly engage said first and second pairs of cover-engaging members and which are hidden from view when said screen enclosure is fully constructed.

3. The method of claim 2, further comprising the step of forming a preselected depending leg of each pair of depending legs of said first and second covers so that a screen-abutting surface of each of said covers is transversely offset from a free end of said depending leg when said free end of said depending leg is in snap-fitting engagement with a cover-engaging means associated with said depending leg.

4. The method of claim 2, further comprising the step of forming said screen-retaining groove in a first preselected depending leg of said pair of depending legs of said first cover and attaching said preselected screen edge to said first cover by inserting said screen retaining means into said screen retaining means-receiving groove formed in said first depending leg.

5. The method of claim 2, further comprising the step of forming said respective exposed surfaces into arcuate surfaces that complement one another so that said confronting first and second pairs of cover members collectively form an elongate hemispherical profile when said screen enclosure is fully constructed.

6. The method of claim 1, further comprising the steps of:

forming a first pair of cover-engaging members along said extent of said frame member on a preselected second side thereof that is opposite to said preselected first side;

forming a second pair of cover-engaging members along said extent of said frame member on said second side thereof in transversely opposed relation to said first pair of cover-engaging members on said second side;

attaching an elongate first cover to said first pair of cover-engaging members on said second side;

attaching a preselected screen edge to said first cover on said second side by inserting a screen retaining means into a screen retaining means-receiving groove formed in said first cover on said second side, said screen retaining means overlying said preselected screen edge;

attaching an elongate second cover to said second pair of cover-engaging members on said second side;

sizing and configuring said first and second covers on said second side so that they confront and substantially abut one another along their respective extents when attached to their respective cover-engaging members and so that they collectively cover said second side of said frame member;

positioning said screen retaining means-receiving groove in said first cover on said second side so that it cannot be seen when said first and second elongate covers on said second side are respectively attached to said first and second cover-engaging members on said second side in confronting relation to one another;

whereby a screen edge secured to said first cover on said second side is sandwiched between said first and second covers on said second side;

whereby the screen retaining means that secures said screen edge to said first cover on said second side is hidden from view;

whereby said first and second pairs of cover-engaging members on said second side are hidden from view; and whereby said second side of said frame member is hidden from view.

7. The method of claim 6, further comprising the step of providing said first cover and said second cover of said second side with respective exposed surfaces that are visible when the screen enclosure is finished and with respective pairs of depending legs that respectively snap-fittingly engage said first and second pairs of cover-engaging members of said second side and which are hidden from view when said screen enclosure is fully constructed.

8. The method of claim 7, further comprising the step of forming a preselected depending leg of each pair of depending legs of said first and second covers of said second side so that a screen-abutting surface of each of said covers is transversely offset from a free end of said depending leg when said free end of said depending leg is in snap-fitting engagement with a cover-engaging means associated with said depending leg.

9. The method of claim 7, further comprising the step of forming said screen-retaining groove in a first preselected depending leg of said pair of depending legs and attaching said preselected screen edge to said first cover of said second side by inserting said screen retaining means into said screen retaining means-receiving groove formed in said first depending leg.

10. The method of claim 7, further comprising the step of forming said respective exposed surfaces into arcuate surfaces that complement one another so that said confronting first and second pairs of cover members of said second side collectively form an elongate hemispherical profile when said screen enclosure is fully constructed.

11. The method of claim 1, further comprising the steps of:

forming a first pair of cover-engaging members along said extent of said frame member on a preselected second side thereof that is normal to said preselected first side;

forming a second pair of cover-engaging members along said extent of said frame member on said second side thereof in transversely opposed relation to said first pair of cover-engaging members on said second side;

attaching an elongate first cover to said first pair of cover-engaging members on said second side;

attaching a preselected screen edge to said first cover on said second side by inserting a screen retaining means into a screen retaining means-receiving groove formed in said first cover on said second side, said screen retaining means overlying said preselected screen edge;

attaching an elongate second cover to said second pair of cover-engaging members on said second side;

sizing and configuring said first and second covers on said second side so that they confront and substantially abut one another along their respective extents when attached to their respective cover-engaging members and so that they collectively cover said second side of said frame member;

positioning said screen retaining means-receiving groove in said first cover on said second side so that it cannot be seen when said first and second elongate covers on said second side are respectively attached to said first and second cover-engaging members on said second side in confronting relation to one another;

whereby a screen edge secured to said first cover on said second side is sandwiched between said first and second covers on said second side;

whereby the screen retaining means that secures said screen edge to said first cover on said second side is hidden from view;

whereby said first and second pairs of cover-engaging members on said second side are hidden from view;

whereby said second side of said frame member is hidden from view; and whereby said normal relation between said first and second sides enables said frame member to be used as a corner post in a screen enclosure.

12. The method of claim 11, further comprising the step of providing said first cover and said second cover of said second side with respective exposed surfaces that are visible when the screen enclosure is finished and with respective pairs of depending legs that respectively snap-fittingly engage said first and second pairs of cover-engaging members and which are hidden from view when said screen enclosure is fully constructed.

13. The method of claim 12, further comprising the step of forming said screen-retaining groove in a first preselected depending leg of said pair of depending legs and attaching said preselected screen edge to said first cover of said second side by inserting said screen retaining means into said screen retaining means-receiving groove formed in said first depending leg.

14. The method of claim 12, further comprising the step of forming a preselected depending leg of each pair of depending legs of said first and second covers of said second side so that a screen-abutting surface of each of said covers is transversely offset from a free end of said depending leg when said free end of said depending leg is in snap-fitting engagement with a cover-engaging means associated with said depending leg.

15. The method of claim 12, further comprising the step of forming said respective exposed surfaces into arcuate surfaces that complement one another so that said confronting first and second pairs of cover members collectively form an elongate hemispherical profile when said screen enclosure is fully constructed.

16. A method for building an aesthetic panel enclosure, wherein the panel is opaque, translucent, or transparent, comprising:

providing an elongate frame member having a predetermined extent and having a predetermined number of sides;

forming a first pair of cover-engaging members along said extent of said frame member on a preselected first side thereof;

forming a second pair of cover-engaging members along said extent of said frame member on said first side thereof in transversely opposed relation to said first pair of cover-engaging members;

attaching an elongate first cover to said first pair of cover-engaging members;

attaching an elongate second cover to said second pair of cover-engaging members;

sizing and configuring said first and second covers so that they confront one another along their respective extents and are spaced apart from one another by a predetermined spacing that is equal to a thickness of a panel when attached to their respective cover-engaging members and so that they collectively cover said preselected side of said frame member;

whereby a panel is sandwiched between said first and second covers;

whereby said first and second pairs of cover-engaging members are hidden from view; and whereby said preselected first side of said frame member is hidden from view, and whereby said cover and said cover-engaging members are associated only with said preselected first side of said frame member.

17. The method of claim 16, further comprising the step of providing said first cover and said second cover with respective exposed surfaces that are visible when the panel enclosure is fully constructed and with respective pairs of depending legs that respectively snap-fittingly engage said first and second pairs of cover-engaging members and which are hidden from view when said panel enclosure is fully constructed.

18. The method of claim 17, further comprising the step of forming a preselected leg of said pair of depending legs of said first and second covers so that a panel-abutting surface of each of said covers is in co-planar alignment with a free end of said depending leg when said free end of said depending leg is in snap-fitting engagement with a cover-engaging means associated with said depending leg.

19. The method of claim 17, further comprising the step of forming a preselected leg of said pair of depending legs of said first and second covers so that a panel-abutting surface of each of said covers is transversely offset from a free end of said depending leg when said free end of said depending leg is in snap-fitting engagement with a cover-engaging means associated with said depending leg.

20. The method of claim 17, further comprising the step of forming said respective exposed surfaces into arcuate surfaces that complement one another so that said confronting first and second pairs of cover members collectively form an elongate hemispherical profile when said panel enclosure is fully constructed.

21. The method of claim 16, further comprising the steps of:

forming a first pair of cover-engaging members along said extent of said frame member on a preselected second side thereof;

forming a second pair of cover-engaging members along said extent of said frame member on said second side thereof in transversely opposed relation to said first pair of cover-engaging members on said second side;

attaching an elongate first cover to said first pair of cover-engaging members on said second side;

attaching an elongate second cover to said second pair of cover-engaging members on said second side;

sizing and configuring said first and second covers on said second side so that they confront one another along their respective extents and are spaced apart from one another by a predetermined spacing that is equal to a thickness of a panel when attached to their respective cover-engaging members and so that they collectively cover said preselected second side of said frame member;

whereby a panel is sandwiched between said first and second covers on said second side;

whereby said first and second pairs of cover-engaging members on said second side are hidden from view; and whereby said second side of said frame member is hidden from view.

22. The method of claim 21, further comprising the step of providing said first cover and said second cover of said second side with respective exposed surfaces that are visible when the screen enclosure is finished and with respective pairs of depending legs that respectively snap-fittingly engage said first and second pairs of cover-engaging members and which are hidden from view when said panel enclosure is fully constructed.

23. The method of claim 22, further comprising the step of forming a preselected leg of said pair of depending legs of said first and second covers of said second side so that a panel-abutting surface of each of said covers is in co-planar alignment with a free end of said depending leg when said free end of said depending leg is in snap-fitting engagement with a cover-engaging means associated with said depending leg.

24. The method of claim 22, further comprising the step of forming a preselected leg of said pair of depending legs of said first and second covers of said second side so that a panel-abutting surface of each of said covers is transversely offset from a free end of said depending leg when said free end of said depending leg is in snap-fitting engagement with a cover-engaging means associated with said depending leg.

25. The method of claim 22, further comprising the step of forming said respective exposed surfaces into arcuate surfaces that complement one another so that said confronting first and second pairs of cover members collectively form an elongate hemispherical profile when said panel enclosure is fully constructed.

26. The method of claim 21, further comprising the steps of:

forming a first pair of cover-engaging members along said extent of said frame member on a preselected second side thereof that is normal to said preselected first side;

forming a second pair of cover-engaging members along said extent of said frame member on said second side thereof in transversely opposed relation to said first pair of cover-engaging members on said second side;

attaching an elongate first cover to said first pair of cover-engaging members on said second side;

attaching an elongate second cover to said second pair of cover-engaging members on said second side;

sizing and configuring said first and second covers on said second side so that they confront and substantially abut one another along their respective extents and are spaced apart from one another by a predetermined spacing that is substantially equal to the thickness of a panel when attached to their respective cover-engaging members and so that they collectively cover said second side of said frame member;

whereby said first and second pairs of cover-engaging members on said second side are hidden from view;

whereby said second side of said frame member is hidden from view; and whereby said normal relation between said first and second sides enables said frame member to be used as a corner post in a screen enclosure.

27. The method of claim 26, further comprising the step of providing said first cover and said second cover of said second side with respective exposed surfaces that are visible when the screen enclosure is finished and with respective pairs of depending legs that respectively snap-fittingly engage said first and second pairs of cover-engaging members and which are hidden from view when said screen enclosure is fully constructed.

28. The method of claim 26, further comprising the step of forming said respective exposed surfaces into arcuate surfaces that complement one another so that said confronting first and second pairs of cover members of said second side collectively form an elongate hemispherical profile when said enclosure is fully constructed.

* * * * *